United States Patent [19]

Saguchi

[11] Patent Number: 4,804,824

[45] Date of Patent: Feb. 14, 1989

[54] REGISTER DRAWER ASSEMBLY

[75] Inventor: Shingo Saguchi, Shizuoka, Japan

[73] Assignee: Tokyo Electric Co., Ltd., Tokyo, Japan

[21] Appl. No.: 98,232

[22] Filed: Sep. 18, 1987

[30] Foreign Application Priority Data

Sep. 26, 1986 [JP] Japan ..... 61-147569[U]

[51] Int. Cl.[4] ..... A47B 81/00

[52] U.S. Cl. ..... 235/7 R; 235/1 R; 312/211; 312/291; 312/308; 312/333; 220/23.83; 206/0.83

[58] Field of Search ..... 235/7 A, 7 R, 1 R, 10, 235/22, 27; 206/0.81–0.83; 220/23, 23.83, 23.86; 312/246, 308, 330 R, 211, 291, 333

[56] References Cited

U.S. PATENT DOCUMENTS 2,735,541 2/1956 Mosler ..... 220/23 X
4,412,709 11/1983 Ishii ..... 235/22 X
4,637,326 1/1987 Baitz et al. ..... 206/0.83 X

FOREIGN PATENT DOCUMENTS 54-49992 4/1979 Japan .
55-124079 9/1980 Japan .

*Primary Examiner*—B. R. Fuller
*Attorney, Agent, or Firm*—Oblon, Fisher, Spivak, McClelland & Maier

[57] ABSTRACT

According to the present invention, a drawer the upper surface of which is open is inserted drawably in an outer case on which is mounted a register, and a receptacle case of an upper-lower double structure comprising a money case as an upper stage the upper surface of which is open and a receptacle portion as a lower stage is inserted in the drawer, with an insertion aperture being formed in the front face of the drawer which insertion aperture is in communication with the receptacle portion, whereby slips, gift coupons, etc. which have been inserted from the insertion aperture and received in the receptacle portion can be transferred as they are to a predetermined place together with the cash received in the money case, and the recovery of those slips, gift coupons, etc. can be done easily without a mistake.

17 Claims, 5 Drawing Sheets

REGISTER DRAWER ASSEMBLY

FIELD OF THE INVENTION

The present invention relates to a register drawer assembly for storing sales money therein and more particularly to a register drawer assembly suitable for the storage of not only cash but also slips, gift coupons and the like.

BACKGROUND OF THE INVENTION

An example of a conventional device is shown in FIGS. 6 and 7. In these figures, the numeral 51 denotes an outer case on which is mounted the register housing. In the outer case 51 are inserted a drawer 52 capable of being drawn out, the upper surface of the drawer 52 being open, a money case 53 received in the drawer 52, the upper surface of the money case 53 being also open, and a cover 54 for closing the money case 53. On the bottom of the drawer 52 are provided bearers 55 for supporting the money case 53, and slits 56 are formed in the front face of the drawer 52.

In using the drawer assembly of such conventional structure, the cover 54 is removed, and cash is put in the money case 53, while a credit card transaction slip 16 or a gift coupon or the like is put into the space between the bottom of the money case 53 and that of the drawer 52 through one of the slits 56. After closing of the shop where the register is installed, the money case 53 is taken out from the drawer 52, and the cover 54 is put thereon, then the covered money case is transferred to a safe custodial place such as a money safe. In this case, the slips 16, gift coupons, etc. stored on the bottom of the drawer 52 are also taken out and transferred to a safe custodial place.

Such prior art has the drawback that, in transferring cash, etc. to a custodial place, the slips 16, gift coupons, etc. stored on the bottom of the drawer 52 must be handled separately from the cash, and this is very troublesome.

OBJECTS OF THE INVENTION

It is a first object of the present invention to provide a register drawer assembly capable of facilitating the recovery of slips, gift coupons and the like.

It is a second object of the present invention to provide a register drawer assembly in which slips, gift coupons and the like once stored are prevented from moving backward to the exterior.

SUMMARY OF THE INVENTION

According to the present invention, in order to achieve the above objects, a drawer the outer surface of which is open is inserted drawably into an outer case on which is mounted a register, and a receptacle case of an upper-lower double structure comprising a money case as an upper stage the upper surface of which is open and a receptacle portion as a lower stage is received in the drawer, the drawer having insertion apertures formed in the front face thereof which apertures are in communication with the receptacle portion. Cash is put in the money case after pulling out the drawer, while slips, gift coupons and the like are inserted into the receptacle portion through the insertion apertures. For the custody of cash, the receptacle case is taken out from the drawer. At the same time, the slips, gift coupons and the like are also taken out in a stored state in the receptacle portion of the receptacle case, now ready for custody to a predetermined place together with the cash.

DESCRIPTION OF THE PREFERRED EMBODIMENTS

The First Embodiment

Figure 1:
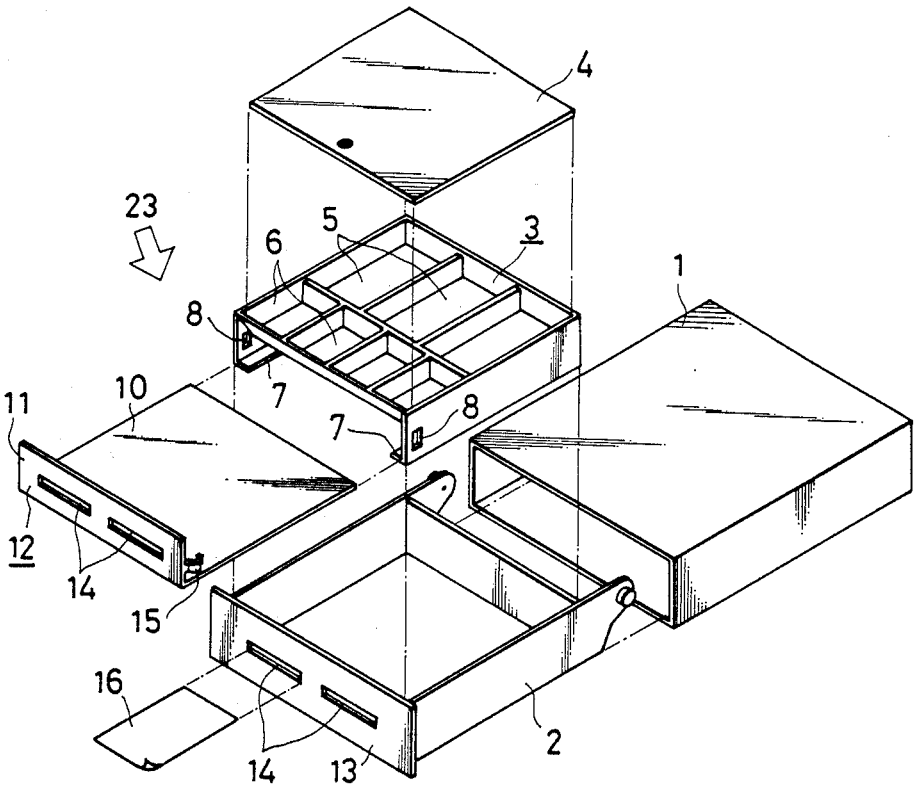
FIG. 1 is an exploded perspective view of the whole showing a first embodiment of the present invention.
Figure 2:
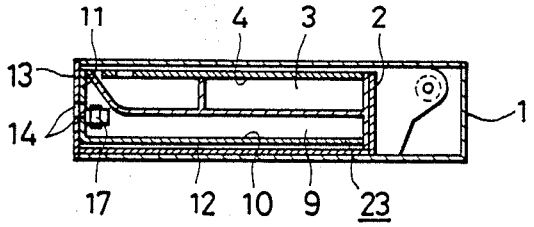
FIG. 2 is a side view in longitudinal section thereof.

A first embodiment of the present invention will now be described with reference to FIGS. 1 and 2. There is provided an outer case 1 on which is mounted a register (not shown), and within the outer case 1 are disposed a drawer 2 capable of being drawn out, the upper surface of the drawer 2 being open, a money case 3 received in the drawer 2, the upper surface of the money case 3 being also open, and a cover 4 for closing the money case 3. In the money case 3 there are formed a plurality of paper money compartments 5 and coin compartments 6, while on both sides of the money case 3 there are formed rail-like guide portions 7 extending downwards from the bottoms of the paper money and coin compartments, and retaining holes 8. Moreover, there is provided an inner drawer 12 which is formed by both a bottom plate 10 and a front plate 11 extending upward perpendicularly from the front edge of the bottom plate 10 and which is disposed along the guide portions 7 so that it can be drawn out, thereby forming a receptacle portion 9 in cooperation with the money case 3. In both a front face 13 of the drawer 2 and the front plate 11 of the inner drawer 12 there are formed slit-like insertion apertures 14 which are in communication with the receptacle portion 9. The insertion apertures 14 of the drawer 2 and of the inner drawer 12 are the same in shape and size. Further, retaining pawls 15 for resilient engagement with the retaining holes 8 are formed integrally on both sides of the inner drawer 12, and a lock mechanism 17 is constituted by both the engaging pawls 15 and the engaging holes 8. The money case 3 and the inner drawer 12 thus interconnected as an integral body constitute a receptacle case 23 of an upper-lower double structure.

In using the drawer assembly of such construction, the drawer 2 is pulled out and the cover 4 removed, then cash is put in the money case 3, while a credit card transaction slip 16 or a gift coupon or the like is inserted through one of the insertion apertures 14 into the receptacle portion 9 located below the money case 3.

After closing of the shop where the register is installed, the receptacle case 23 is taken out from the drawer 2 and, after putting the cover 4 thereon, the case is transferred to a safe custodial place such as a money safe. In this case, the money case 3 and the inner drawer 12 are taken out simultaneously in an integral condition. Thus, the slips 16, etc. stored in the receptacle portion 9 are also taken out together with the cash stored in the money case 3 and so never remain on the bottom of the drawer 2. Consequently, the troublesomeness of the recovering work for the slips 16, etc. is eliminated and the recovery is ensured. For taking out the slips 16, etc. from the receptacle portion 9, the inner drawer 12 is pulled out from the money case 3.

Since the money case 3 and the inner drawer 12 are locked by the lock mechanism 17, the inner drawer 12 is prevented from coming off the money case 3 in transit.

The Second Embodiment

A second embodiment of the present invention will now be described with reference to FIG. 3, in which the same portions as in the first embodiment are indicated by the same reference numerals to omit explanation (as is also the case in the following). In this embodiment, insertion apertures 14 are formed in the shape of a true circle. Although in FIG. 3 there are shown such insertion apertures 14 only in the front face 13 of the drawer 2, there are formed insertion apertures 14 of the same shape and same size also in the front plate 11 of the inner drawer 12. Therefore, a slip 16 or the like is rounded and in this state it is inserted from an insertion aperture 14 into the receptacle portion 9. The slip 16 or the like then restores its shape in the receptacle portion 9, so once inserted into the receptacle portion 9, it is prevented from moving backward to the exterior through the insertion aperture 14.

Figure 4:
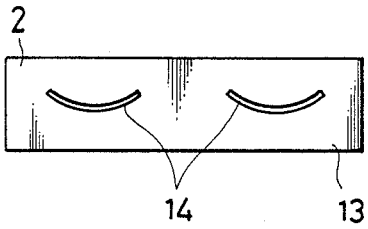
FIG. 4 is a front view of the whole showing a modification of insertion apertures.

FIG. 4 shows a modification in shape of insertion apertures 14, which are formed in the shape of a meniscus. Even with such a shape of insertion apertures 14, the slip 16 once stored can be prevented from moving backward to the exterior.

Figure 3:
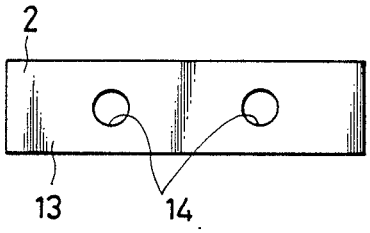
FIG. 3 is a front view of the whole showing a second embodiment of the present invention.

The shape of the insertion apertures 14 is not limited to the circular shape shown in FIG. 3 or the meniscus shape shown in FIG. 4. There may be adopted any shape if only it can prevent a backward movement of the slip 16, etc.

The Third Embodiment

Figure 5:
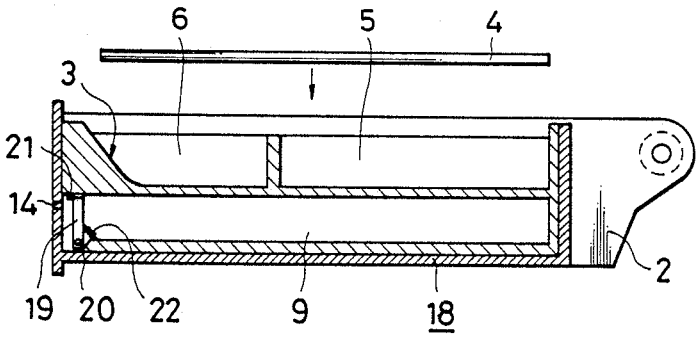
FIG. 5 is a side view in longitudinal section showing a third embodiment of the present invention.
Figure 6:
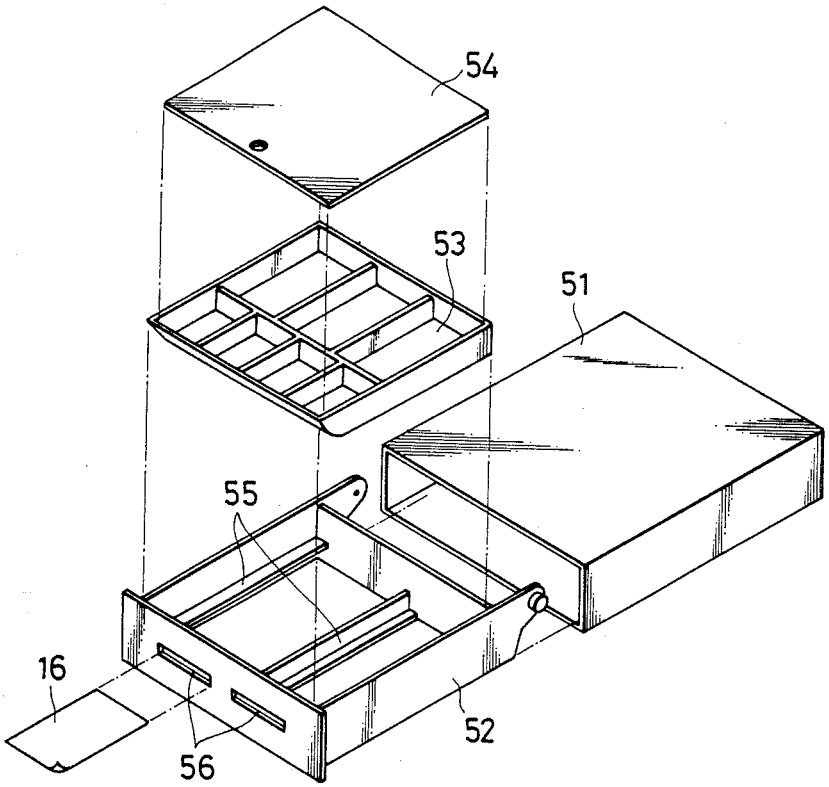
FIG. 6 (PRIOR ART)
FIG. 6 is an exploded perspective view of the whole showing a conventional example.
Figure 7:
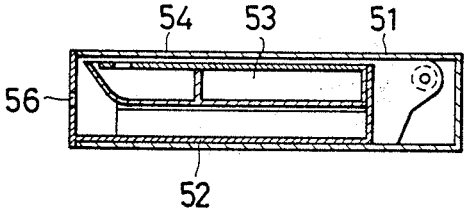
FIG. 7 (PRIOR ART)
FIG. 7 is a side view in longitudinal section thereof.

A third embodiment of the present invention will now be described with reference to FIG. 5. This embodiment employs a receptacle case 18 which is constituted by an integral member of an upper-lower double structure. More specifically, the receptacle case 18 comprises a money case 3 as an upper stage the upper surface of which is open and a receptacle portion 9 as a lower stage the front face of which is open, with a receptacle cover 19 being attached to the open front of the receptacle portion 9. The receptacle cover 19 is pivotable about a pivot shaft 20 mounted to the lower portion thereof, and its forward pivotal movement is prevented by a stopper 21 projecting downwards from the upper surface of the receptacle portion 9. Further, the receptacle cover 19 is urged against the stopper 21 by means of a spring 22 mounted between the cover and the lower surface of the receptacle portion 9.

In such construction, when a slip 16 is inserted through an insertion aperture 14 formed in only the front face 13 of the drawer 2, the receptacle cover 19 is opened by the slip 16, thereby allowing the slip to be received in the receptacle portion 9. Thereafter, the cover 19 is closed by virtue of the spring 22, whereby the slip 16 is held in the receptacle portion 9.

The force required for opening the receptacle cover 19 must be weaker than the strength of the slip 16 capable of withstanding the bending force acting upon abutment with the cover 19. Therefore, such shapes of the insertion apertures 14 as shown in FIGS. 3 and 4, which shapes can enhance the strength of the slip 16, are more suitable for this embodiment.

What is claimed is:

1. A register drawer assembly comprising:
(a) a drawer having an upper surface and a front face inserted drawably in an outer case on which is mounted a register, the upper surface of said drawer being open;
(b) a receptacle case inserted in said drawer, said receptacle case having an upper-lower double structure comprising a money case as an upper stage having an upper surface, the upper surface of said money case being open, and an inner drawer as a lower stage;
(c) at least one first insertion aperture formed in the front face of said drawer in a position communicating with said receptacle case;
(d) downwardly extending guide portions formed on both sides of said money case, said inner drawer being disposed along said downwardly extending guide portions; and
(e) a lock mechanism for locking said inner drawer, said lock mechanism being composed of engaging holes formed in said money case and engaging pawls integral with said inner drawer for resilient engagement with said engaging holes.

2. A register drawer assembly according to claim 1, wherein said at least one first insertion aperture is formed in a shape of a slit.

3. A register drawer assembly according to claim 1, wherein said at least one first insertion aperture is formed in a shape of a circle.

4. A register drawer assembly according to claim 1, wherein said at least one first insertion aperture is formed in a shape of a meniscus.

5. A register drawer assembly according to claim 1, wherein said inner drawer is composed of:
(a) a bottom plate disposed drawably along said guide portions;
(b) a front plate extending vertically upwards from said bottom plate to provide a front face of said receptacle case; and
(c) at least one second insertion aperture formed in said front plate, said at least one second insertion aperture communicating with said at least one first insertion aperture formed in said drawer.

6. A register drawer assembly according to claim 5, wherein said at least one first insertion aperture and said at least one second insertion aperture are formed in conformity with each other.

7. A register drawer assembly comprising:
(a) a drawer having an upper surface and a front face inserted drawably in an outer case on which is mounted a register, the upper surface of said drawer being open;
(b) a receptacle case inserted in said drawer, said receptacle case having an upper-lower double structure comprising a money case as an upper stage having an upper surface, the upper surface of said money case being open, and an inner drawer having a front portion as a lower stage;
(c) at least one first insertion aperture formed in the front face of said drawer in a position communicating with said receptacle case; and
(d) a receptacle cover attached to the front portion of said inner drawer, said receptacle cover being adapted to open upon exertion of a backward urging force thereon.

8. A register drawer assembly according to claim 7, wherein said at least one first insertion aperture is formed in a shape of a slit.

9. A register drawer assembly according to claim 7, wherein said at least one first insertion aperture is formed in a shape of a circle.

10. A register drawer assembly according to claim 7, wherein said at least one first insertion aperture is formed in a shape of a meniscus.

11. A register drawer assembly according to claim 7, wherein downwardly extending guide portions are formed on both sides of said money case, said inner drawer being disposed along said downwardly extending guide portions.

12. A register drawer assembly according to claim 11, wherein said inner drawer is composed of:

(a) a bottom plate disposed drawably along said guide portions;

(b) a front plate extending vertically upwards from said bottom plate to define a front face of said receptacle case; and (c) at least one second insertion aperture formed in said front plate, said at least one second insertion aperture communicating with said at least one first insertion aperture formed in said drawer.

13. A register drawer assembly according to claim 12, wherein said at least one first insertion aperture and said at least one second insertion aperture are formed in conformity with each other.

14. A register drawer assembly according to claim 11 and further comprising a lock mechanism for locking said inner drawer.

15. A register drawer assembly according to claim 14, wherein said lock mechanism is composed of engaging holes formed in said money case and engaging pawls integral with said inner drawer for resilient engagement with said engaging holes.

16. A register drawer assembly comprising:

(a) a drawer having an upper surface and a front face inserted drawably in an outer case on which is mounted a register, the upper surface of said drawer being open;

(b) a receptacle case inserted in said drawer, said receptacle case having an upper-lower double structure comprising a money case as an upper stage having an upper surface, the upper surface of said money case being open, and a receptacle portion including an inner drawer as a lower stage;

(c) at least one first insertion aperture formed in the front face of said drawer in a position communicating with said receptacle portion; and (d) downwardly extending guide portions formed on both sides of said money case and united thereto, said inner drawer being disposed along said downwardly extending guide portions.

17. A register drawer assembly comprising:

(a) a drawer having an upper surface and a front face inserted drawably in an outer case on which is mounted a register, the upper surface of said drawer being open;

(b) a receptacle case inserted in said drawer, said receptacle case having an upper-lower double structure comprising a money case as an upper stage having an upper surface, the upper surface of said money case being open, and a receptacle portion as a lower stage;

(c) at least one first insertion aperture formed in the front face of said drawer in a position communicating with said receptacle portion; and (d) a receptacle cover attached to a front portion of said receptacle portion, said receptacle cover being adapted to open upon exertion of a backward urging force thereon.

* * * * *